United States Patent [19]

Chang

[11] Patent Number: 5,014,485

[45] **Date of Patent: * May 14, 1991**

[54] CHAIR FOR REINFORCEMENT ROD

[76] Inventor: Jyh-Chin Chang, 38, Kuang-Ming St., Pei-Chen Li, Lo-Tung, Yi-Lan Hsien, Taiwan

[ * ] Notice: The portion of the term of this patent subsequent to May 29, 2007 has been disclaimed.

[21] Appl. No.: 505,923

[22] Filed: Apr. 6, 1990

Related U.S. Application Data

[63] Continuation-in-part of Ser. No. 342,992, Apr. 24, 1989, Pat. No. 4,928,472.

[51] Int. Cl.[5] ..... E04C 5/16

[52] U.S. Cl. ..... 52/678; 52/686; 52/687

[58] Field of Search ..... 52/678, 686, 687, 677

[56] References Cited

U.S. PATENT DOCUMENTS 4,060,954 12/1977 Liuzza ..... 52/677

4,928,472 5/1990 Chang ..... 52/678

*Primary Examiner*—Richard E. Chilcot, Jr.

*Attorney, Agent, or Firm*—Wells, St. John & Roberts

[57] ABSTRACT

A chair used for supporting concrete reinforcement rods provides different supporting levels by a change in position thereof, and includes top and bottom planar transverse frame members spaced by two pairs of connecting rods, a pair of first leg members extending from the top frame member, and a pair of second leg members extending from the bottom frame member. Reinforcement transverse members are provided between leg members and connecting rods and are connected to the top and bottom frame members, respectively, thereby improving the strength of the chair.

2 Claims, 4 Drawing Sheets

CHAIR FOR REINFORCEMENT ROD

BACKGROUND OF THE INVENTION

This application is a Continuation-In-Part application of U.S. patent application Ser. No. 07/342,992 which was filed on Apr. 24, 1989, now U.S. Pat. No. 4,928,472.

This invention relates to a chair used for supporting concrete reinforcement rods and spacing them from a concrete form.

The parent application discloses a chair shown in FIGS. 1, 2 and 3, which comprises a planar rectangular transverse top frame member (a), a planar rectangular transverse bottom frame member (b), and two pairs of first connecting members (c) placed between and connected to intermediate parts of the top and bottom frame members. Two pairs of first leg members (d) respectively extend upward from the corners of the top frame member, and two pairs of second leg members (e) respectively extend downward from the corners of the bottom frame member. The chair provides different supporting levels by a change in position so that different spacing selections can be obtained for reinforcement rods.

SUMMARY OF THE INVENTION

The object of the present invention is to provide the chair of the parent application with a stronger construction.

According to the present invention, the first and second leg members are provided with reinforcement transverse members which interconnect the leg members and are in turn connected to the top and bottom frame members. The connecting rods are provided with bracing parts which interconnect the connecting rods and are in turn connected to the top and bottom frame members.

The present exemplary preferred embodiments will be described in detail with reference to the accompanying drawings, in which:

DETAILED DESCRIPTION OF PREFERRED EMBODIMENTS

Figure 4:
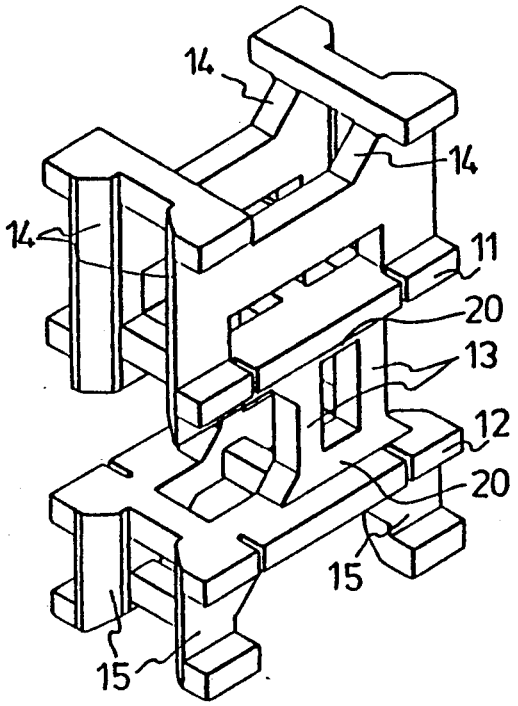
FIG. 4 is a perspective view of a first embodiment of the present application.

Referring to FIG. 4, the construction of a chair 1 for concrete reinforcing rods in this application is in most part identical to that disclosed in the parent application of this application. The chair comprises a planar rectangular transverse top frame member 11, a planar rectangular transverse bottom frame member 12, two pairs of connecting members 13 placed between and connected to intermediate parts of the top and bottom frame members 11,12. Two pairs of first leg members 14 respectively extend upward from the corners of the top frame members, and two pairs of second leg members 15 respectively extend downward from the corners of the bottom frame member 12.

Figure 1:
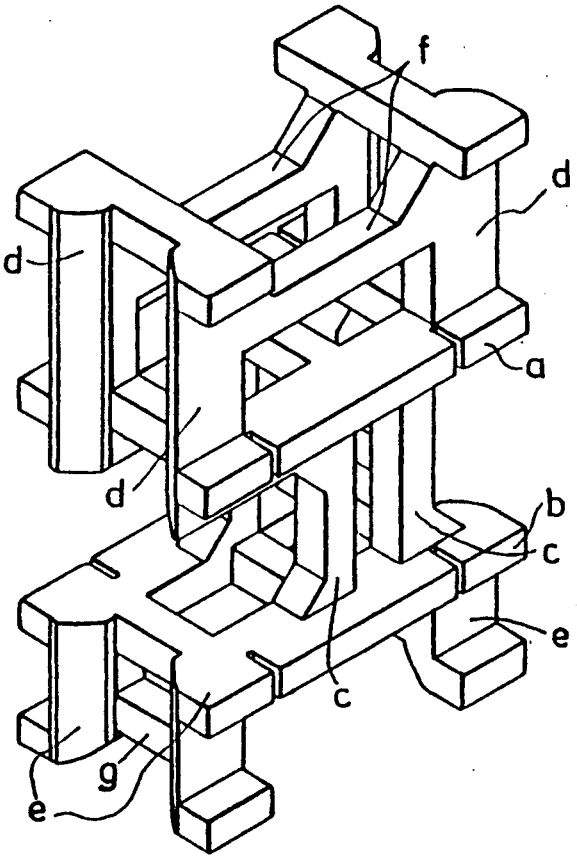
FIGS. 1, 2 and 3 show a chair disclosed in the parent of this application.

The difference between the chair of FIG. 1 and that of the parent application is the provision of a bracing part 20 between each pair of connecting members 13. The bracing parts 20 are connected to the top and bottom planar frame members 11, 12 respectively.

Figure 2:
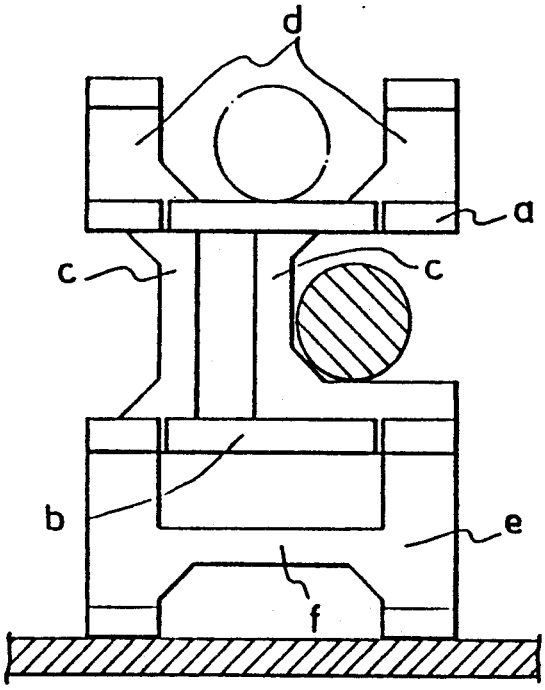
Figure 5:
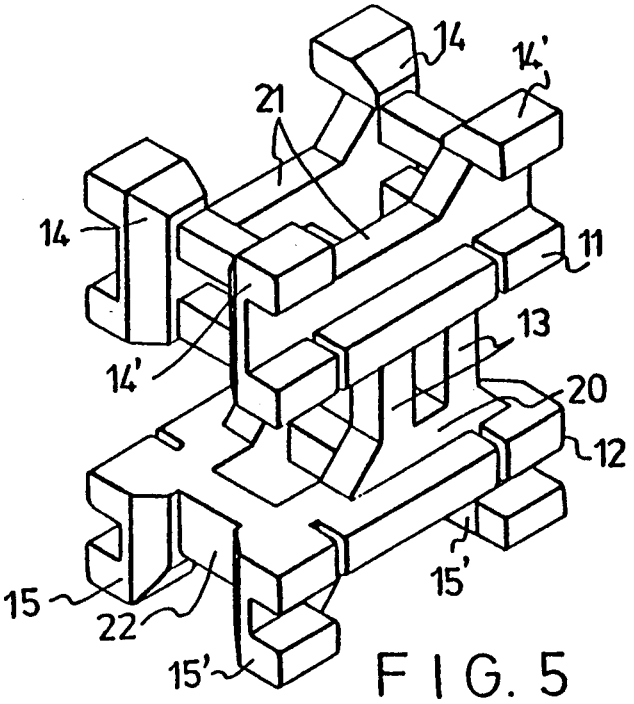
FIG. 5 is a perspective view of a second embodiment of the present application.
Figure 6:
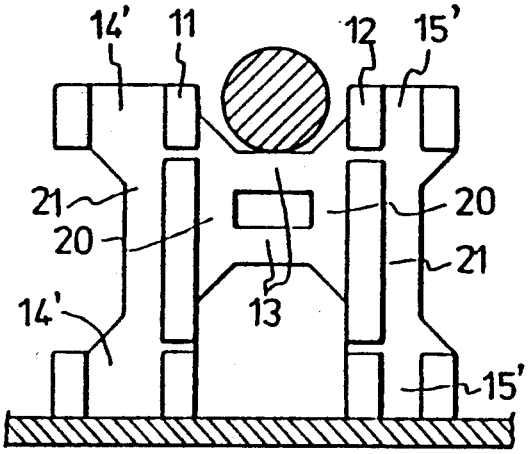
FIG. 6 is a side view of the second embodiment.
Figure 7:
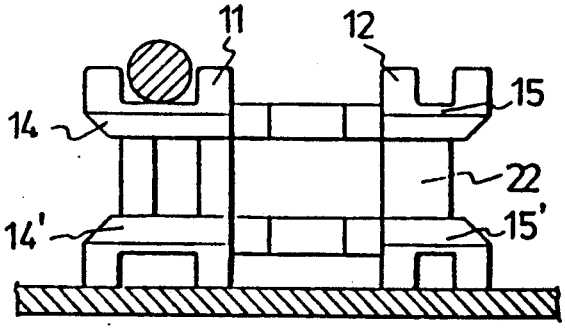
FIG. 7 is another side view of the second embodiment.

Referring to FIGS. 5 to 7, the second embodiment of the invention is substantially similar to the embodiment shown in FIG. 4 except that: each pair of first leg members 14 or 14' has a reinforcement transverse member 21 which interconnects the first leg members 14 or 14' and is, in turn, connected to the top planar frame member 11; and each pair of second leg members 15 or 15' also has a reinforcement transverse member 21 which interconnects the second leg members 15 or 15' and is, in turn, connected to the bottom planar frame member 12. From FIGS. 2 and 6, it can be noted that the reinforcements transverse members 21 are not provided in the chair of the parent invention and, instead, bridging rods f which are spaced from the top and bottom members 11, 12 interconnect the leg members 14, 15. It can also be noted that the bracing parts 20 are not provided in the parent application.

Figure 3:
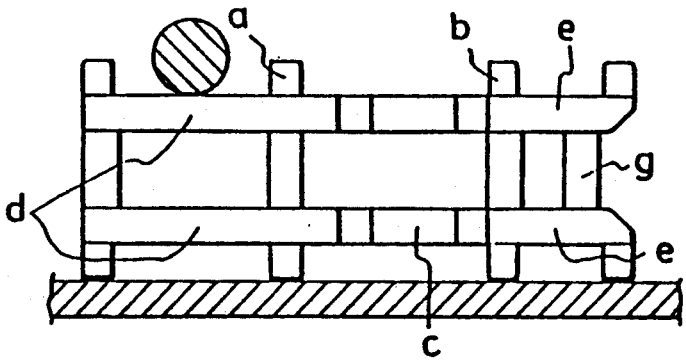

This embodiment further has a reinforcement transverse member 22 which interconnects leg members 15, 15' and in turn is connected to the bottom frame member 12. From FIGS. 3 and 7, it can be noted that this reinforcement transverse member 22 is not provided in the chair of the parent application.

With the invention thus explained, it can be noted that various modifications and variations can be made without departing from the scope of the spirit of the invention. It is therefore intended that the invention be limited only as indicated in the appended claims.

What I claim is:

1. A chair for concrete reinforcing rods comprising:

a body having a planar top frame member and a planar bottom frame member, each having a front side, a rear side, a left side and a right side, and two pairs of first connecting members placed between and connected to intermediate parts of said top and said bottom frame members;

said body further having two pairs of first leg members respectively extending upward from the corners of said top frame member, and two pairs of second leg members respectively extending downward from the corners of said bottom frame member;

said first connecting members and said top and said bottom frame members confining a left and a right first support seat adjacent said left and right sides of said top and said bottom frame members;

said first leg members and said bottom frame member confining a second support seat;

said second leg members and said bottom frame member confining a third support seat;

said second support seat being operative and said left and said right sides of said bottom frame member serving as an additional lower level supporting seat when said second leg members are placed downward, said third support seat being operative and said left and said right sides of said top frame member serving as an additional lower level supporting seat when said first leg members are placed downward, said first and said second leg members being different in length so that said second and said third support seats provide different supporting levels;

said left first support seat being operative when said right sides of said top and bottom frame members are placed downward, said right first support seat being operative when said left sides of said top and bottom frame members are placed downward;

said first connecting members having different distances from said left and right sides of said top and bottom frame members so that said left and right first support seats provide different supporting levels; and improvements wherein each pair of said first connecting members has two bracing parts which interconnect said first connecting members and in turn are connected to said top and bottom frame members, respectively.

2. A chair as claimed in claim 1, further including improvements in which each pair of said first leg members have a reinforcement transverse member which interconnects said first leg members and is, in turn, connected to said top planar frame member, and each pair of said second leg members also have another reinforcement transverse member which interconnects said second leg members and is, in turn, connected to said bottom planar frame member.

* * * * *